US010396422B1

(12) United States Patent
Rojas et al.

(10) Patent No.: US 10,396,422 B1
(45) Date of Patent: Aug. 27, 2019

(54) APERTURED WAVEGUIDES FOR ELECTROMAGNETIC WAVE TRANSMISSION

(71) Applicants: Eduardo Antonio Rojas, Tampa, FL (US); Justin Troy Nussbaum, Tampa, FL (US); Thomas McCrea Weller, Lutz, FL (US); Nathan Brad Crane, Lutz, FL (US)

(72) Inventors: Eduardo Antonio Rojas, Tampa, FL (US); Justin Troy Nussbaum, Tampa, FL (US); Thomas McCrea Weller, Lutz, FL (US); Nathan Brad Crane, Lutz, FL (US)

(73) Assignee: University of South Florida, Tampa, FL (US)

( * ) Notice: Subject to any disclaimer, the term of this patent is extended or adjusted under 35 U.S.C. 154(b) by 24 days.

(21) Appl. No.: 15/460,169

(22) Filed: Mar. 15, 2017

Related U.S. Application Data

(60) Provisional application No. 62/308,607, filed on Mar. 15, 2016.

(51) Int. Cl.
*H01P 1/207* (2006.01)
*H01P 3/123* (2006.01)

(52) U.S. Cl.
CPC ..... *H01P 3/123* (2013.01); *H01P 1/207* (2013.01)

(58) Field of Classification Search
CPC ..... H01P 3/123; H01P 1/207; H01P 7/105; H01P 1/2086; H01P 1/211
USPC ..... 333/185, 208
See application file for complete search history.

(56) References Cited

U.S. PATENT DOCUMENTS 3,292,115 A * 12/1966 La Rosa ..... H01P 3/122 174/50
3,474,354 A 10/1969 Simon
4,323,867 A 4/1982 Temes
5,173,714 A * 12/1992 Arimura ..... H01Q 13/16 343/770

OTHER PUBLICATIONS

D'Auria et al., "3-D Printed Metal-Pipe Rectangular Waveguide," IEEE Transactions on Components, Packaging and Manufacturing Technology, vol. 5, No. 9, Sep. 2015.
Geterud, E. ; Bergmark, P. ; Yang, J. (2013) "Lightweight Waveguide and Antenna Components Using Plating on Plastics". 7th European Conference on Antennas and Propagation, EuCAP 2013, Gothenburg, Sweden, Apr. 8-12, 2013 pp. 1812-1815.
McKerricher, G.; Nafe, A.; Shamim, A., "Lightweight 3D printed microwave waveguides and waveguide slot antenna," in Antennas and Propagation & USNC/URSI National Radio Science Meeting, 2015 IEEE International Symposium,, vol., No., pp. 1322-1323, Jul. 19-24, 2015.

(Continued)

*Primary Examiner* — Robert J Pascal
*Assistant Examiner* — Kimberly E Glenn
(74) *Attorney, Agent, or Firm* — Thomas Horstemeyer, LLP

(57) ABSTRACT

In some embodiments, an apertured waveguide includes a wall comprising a plurality of apertures and an interior channel along which electromagnetic waves can propagate, the interior channel being defined at least in part by the wall.

30 Claims, 5 Drawing Sheets

(56) References Cited

OTHER PUBLICATIONS

H. Kazemi, D. Miller, A. Mohan, Y. Jin, M. Crawford, M. Wagenseil, et al., "Ultra-compact Gband 16way power splitter/combiner module fabricated through a new method of 3D-copper additive manufacturing," in Microwave Symposium (IMS), 2015 IEEE MTT-S International, 2015, pp. 1-3.

T. Merkle, R. Gotzen, C. Joo-Young, and S. Koch, "Polymer Multichip Module Process Using 3-D Printing Technologies for D-Band Applications," Microwave Theory and Techniques, IEEE Transactions on, vol. 63, pp. 481-493, 2015.

G.-L. Huang, S.-G. Zhou, T.-H. Chio, and T.-S. Yeo, "3-D metal-direct-printed wideband and highefficiency waveguide-fed antenna array," in Microwave Symposium (IMS), 2015 IEEE MTT-S International, 2015, pp. 1-4.

C. Fan, C. Yung-hang, W. Kan, W. T. Khan, S. Pavlidis, and J. Papapolymerou, "High resolution aerosol jet printing of D-band printed transmission lines on flexible LCP substrate," in Microwave Symposium (IMS), 2014 IEEE MTT-S International, 2014, pp. 1-3.

T. P. Ketterl, Y. Vega, N. C. Amal, J. W. I. Stratton, E. A. Rojas-Nastrucci, M. F. Cordoba-Erazo, et al., "A 2.45 GHz Phased Array Antenna Unit Cell Fabricated Using 3-D Multi-Layer Direct Digital Manufacturing," Microwave Theory and Techniques, IEEE Transactions on, vol. 63, pp. 4382-4394, 2015.

E. A. Rojas-Nastrucci, T. Weller, V. Lopez Aida, C. Fan, and J. Papapolymerou, "A study on 3D-printed coplanar waveguide with meshed and finite ground planes," in Wireless and Microwave Technology Conference (WAMICON), 2014 IEEE 15th Annual, 2014, pp. 1-3.

* cited by examiner

APERTURED WAVEGUIDES FOR ELECTROMAGNETIC WAVE TRANSMISSION

CROSS-REFERENCE TO RELATED APPLICATION

This application claims priority to U.S. Provisional Application Ser. No. 62/308,607, filed Mar. 15, 2016, which is hereby incorporated by reference herein in its entirety.

NOTICE OF GOVERNMENT-SPONSORED RESEARCH

This invention was made with Government support under grant contract number ECCS-1232183 awarded by the National Science Foundation. The Government has certain rights in the invention.

BACKGROUND

Metal waveguides are often used in high-power, low-loss applications, such as satellites, radar systems, and space craft. Electroless-plated, three-dimensional printed plastic parts are a lightweight option for the realization of waveguide circuits, but this technology suffers from limited power capability due to the low glass transition temperatures of the plastics and delamination issues. In addition, such parts exhibit higher loss as compared to solid metal waveguides. For high-power applications, and where loss is an important factor, solid metal waveguides are the option of choice although, but they are accompanied by higher weight and the need for greater amounts of material. In view of the above discussion, it can be appreciated that it would be desirable have high-performance, solid metal waveguides having less weight and requiring less material to construct.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable have high-performance, solid metal waveguides having less weight and requiring less material to construct. Disclosed herein are examples of such waveguides. In some embodiments, the waveguides are apertured waveguides, i.e., waveguides having a plurality of apertures provided in the walls of the waveguide so as to reduce material and, therefore, weight. As described below, significant weight reduction is possible while still maintaining low loss characteristics. In some embodiments, the waveguides are constructed using an additive manufacturing process.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
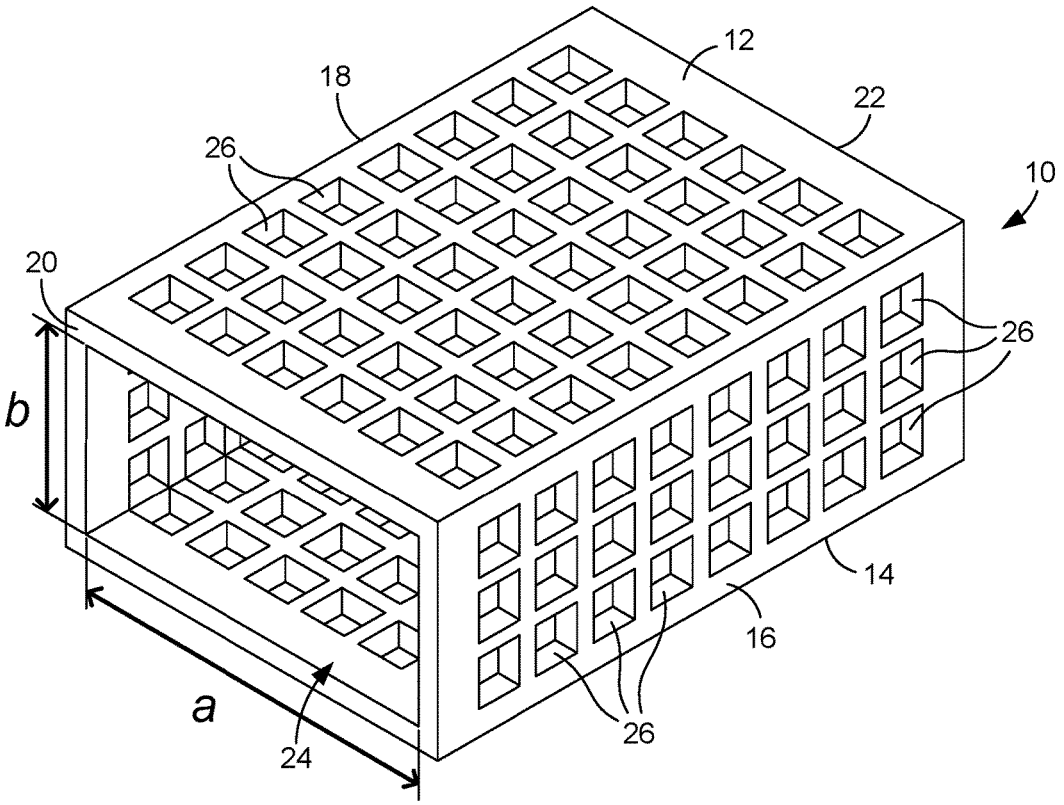
FIG. 1 is a perspective view of an embodiment of an apertured waveguide.
Figure 2:
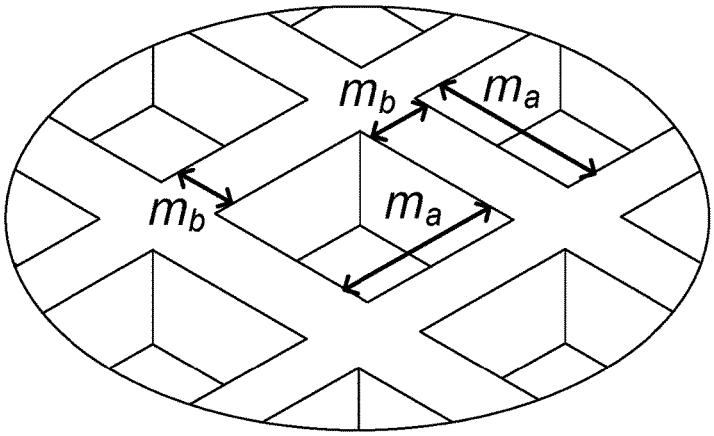
FIG. 2 is a detail view of the structure of one of the walls of the apertured waveguide of FIG. 1.
Figure 3:
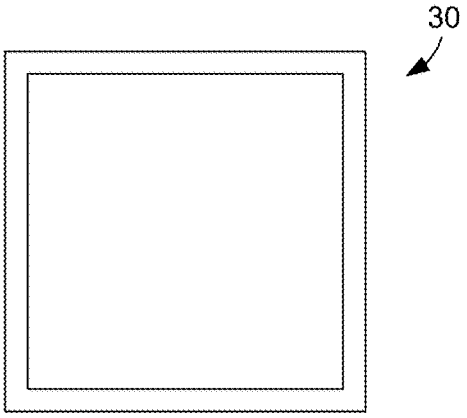
FIG. 3 is an end view of an embodiment of an apertured waveguide having a square cross-section.
Figure 4:
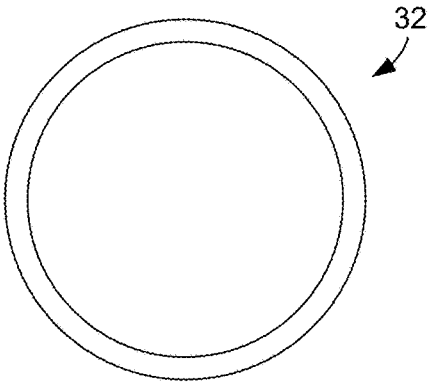
FIG. 4 is an end view of an embodiment of an apertured waveguide having a circular cross-section.
Figure 5:
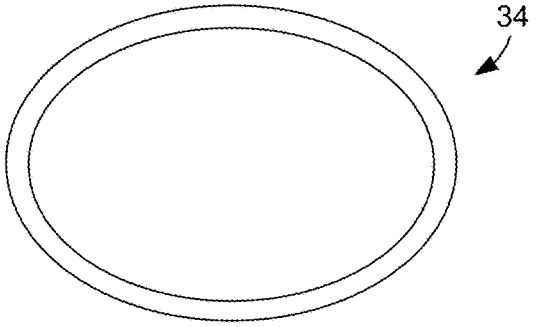
FIG. 5 is an end view of an embodiment of an apertured waveguide having an elliptical cross-section.
Figure 6A:
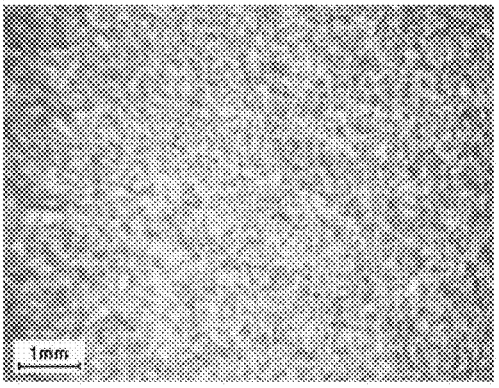
FIGS. 6A-6D are images of the walls of fabricated apertured waveguides, including a solid-walled waveguide (FIG. 6A) and three examples of apertured waveguides (FIGS. 6B-6D).
Figure 6B:
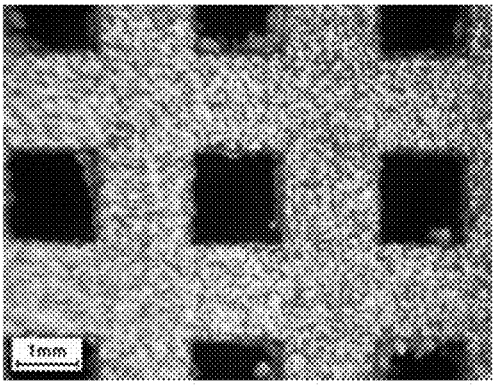
Figure 6C:
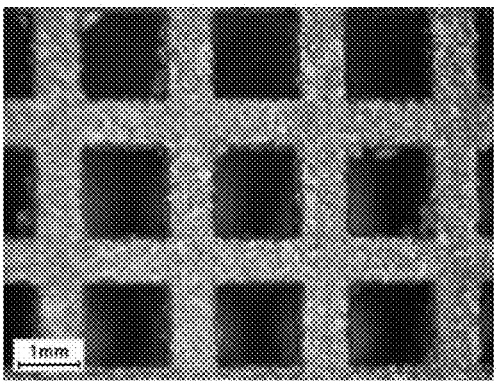
Figure 6D:
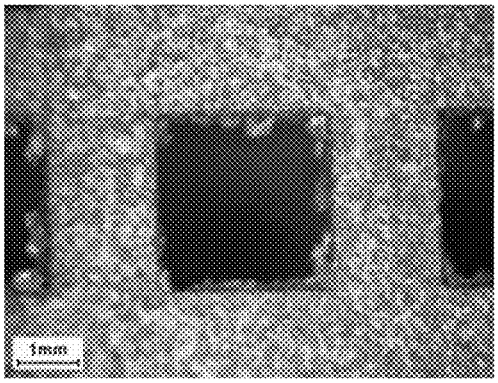

It has been determined that a low-weight, high-power, low-loss metal waveguide can be achieved by providing the wall or walls of the waveguide with a plurality of apertures so as to reduce the amount of material the waveguide comprises. FIGS. 1 and 2 illustrate an example of such a waveguide 10. As shown in FIG. 1, the waveguide 10 is configured as a rectangular (i.e., rectangular in cross-section) solid metal waveguide. Although a rectangular configuration is depicted in FIG. 1, it is to be understood that other geometries can be used, as desired. FIGS. 3-5 illustrate examples of other geometries. In particular, FIG. 3 shows a square solid metal waveguide 30, FIG. 4 shows a circular solid metal waveguide 32, and FIG. 5 shows an elliptical solid metal waveguide 34. It is further noted that, in some embodiments, the waveguide 10 need not be solid metal. For example, the waveguide 10 can be composed of a polymeric material that is plated with metal for lower power applications.

With reference back to FIG. 1, the waveguide 10 comprises four orthogonally arranged walls, including a top wall 12, a bottom wall 14, and first and second lateral walls 16 and 18. Together, these walls 12-18 define first and second end surfaces 20 and 22, and an interior channel 24 along which electromagnetic waves, such as microwaves, can travel. As indicated in the figure, this interior channel 24 has a width dimension, a, and a height dimension, b, examples for these dimensions being identified below.

With continued reference to FIG. 1, each wall 12-18 includes a plurality of apertures 26 (i.e., openings or holes) arranged in arrays of parallel rows and parallel columns, the rows and columns being perpendicular to each other. As such, the waveguide 10 and/or its walls can be referred to as "apertured." In cases such as that shown in FIG. 1, in which the number and/or size of the apertures is large, the waveguide 10 and/or its walls 12-18 can be referred to as "meshed." In such a case, each wall 12-18 can comprise apertures 26 across substantially its entire area. In the illustrated embodiment, each of the apertures 26 is rectangular and, more particularly square. Like the cross-section of the waveguide 10, however, other geometries can be used. For example, the apertures 26 could instead be circular or elliptical. As indicated in the detail view of FIG. 2, each aperture 22 has a cross-sectional dimension (width and length) of $m_a$ and each aperture is separated or spaced from adjacent apertures by a distance $m_b$.

The various dimensions of the waveguide 10, including the width, a, and height, b, of the interior channel 24, the dimensions of the apertures 26, $m_a$, and the spacing of the apertures, $m_b$, as well as the thickness of the walls 12-18, can each be selected based upon the application in which the waveguide is going to be used and, therefore, the frequencies of the electromagnetic waves that are be propagated by the waveguide. For example, for microwave frequency applications, a can be approximately 7.1 to 165.1 mm, b can be approximately 3.6 to 82.5 mm, $m_a$ can be approximately 0.1 to 20 mm, $m_b$ can be approximately 0.1 to 20 mm, and the thickness of the walls 12-18 can be approximately 0.2 to 5 mm.

In order to explore the effect that apertures provided in the walls have on the performance of an apertured waveguide, a set of Ku band (WR-62) rectangular waveguides were designed. One solid-walled waveguide and three different apertured or meshed waveguides, M1, M2, and M3, were modeled. Each waveguide had an "a" dimension of 15.8 mm, a "b" dimension of 7.9 mm, and a wall thickness of 1 mm. As indicated in Table I, waveguide M1 had an $m_a$ dimension of 1.44 mm and an $m_b$ dimension of 1.56 mm, waveguide M2 had an $m_a$ dimension of 1.46 mm and an $m_b$ dimension of 0.73 mm, and waveguide M3 had an $m_a$ dimension of 2.67 mm and an $m_b$ dimension of 1.47 mm. The length of each waveguide was 25.26 mm. As a reference parameter, the "density" of the waveguides is considered to be the ratio between the volume of the waveguide and the solid-walled waveguide (excluding end flanges that were used for mounting purposes). Accordingly, M2 and M3 had similar densities.

TABLE I

Propagation Characteristic

| Line | α (dB/cm) | β (rad/m) @15 GHz | Density ( $Vol_{mesh}$/ $Vol_{solid}$) |
|---|---|---|---|
| Solid-Simulation | 0.0134 | 243.63 | 1 |
| Solid-Measured | 0.019 | 245.56 | 1 |
| M1 $m_a$ = 1.44 mm $m_b$ = 1.56 mm | 0.020 | 247.96 | 0.78 |
| M2 $m_a$ = 1.46 mm $m_b$ = 0.73 mm | 0.025 | 249.50 | 0.61 |
| M3 $m_a$ = 2.67 mm $m_b$ = 1.47 mm | 0.29 | 253.63 | 0.65 |

Notably, the waveguide structures described above can be used to construct filters. Accordingly, depending upon the configuration and dimensions used, some embodiments of apertured waveguides can be described as waveguide filters. To demonstrate how an apertured waveguide can be used as a filter, a 4-pole Chebyshev cavity filter was designed with a center frequency of 16.5 GHz and a bandwidth of 700 MHz. The walls of this filter were meshed and had apertures with dimensions of $m_a$=2.1 mm and $m_b$=0.6 mm, for a final density of approximately 60%. These filters had irises that were 2 mm thick and had total lengths of 63.7 mm.

The designed apertured waveguides and filters were fabricated with an Exone Innovent printer. This machine uses a metal binder jetting additive manufacturing process. An inkjet-like print head was used to deposit binder onto a bed covered with 4 to 20 stainless steel powder particles having an average diameter of approximately 30 μm. Once a first two-dimensional cross-section (layer) of the part was printed, the binder was partially dried using an infrared heat lamp. A new layer of metal powder was then deposited on top of the first layer and the process was repeated in this manner until the modeled part was completed. The entire powder bed was then placed in a convection oven for 4 hours at 185° C. to finish curing the binder.

The resulting "green" part was then infiltrated to reduce its porosity. For infiltration, the part was removed from the powder bed and packed into a crucible along with copper powder. The part was then placed in a high-temperature oven and the internal temperature was maintained at 1120° C. for 24 hours. This caused all of the binder to burn off while sintering together the stainless steel powder and molten the copper. The molten copper, which was in contact with the part, infiltrated into the matrix under capillary forces. This created an interconnected stainless steel structure in a copper matrix. The part was then cooled and removed from the crucible. FIGS. 6A-6D show images of the walls of the fabricated waveguides. Residue of the alumina powder used to surround the parts to ensure proper heat distribution during the infiltration cycle can be seen in these images.

Figure 7A:
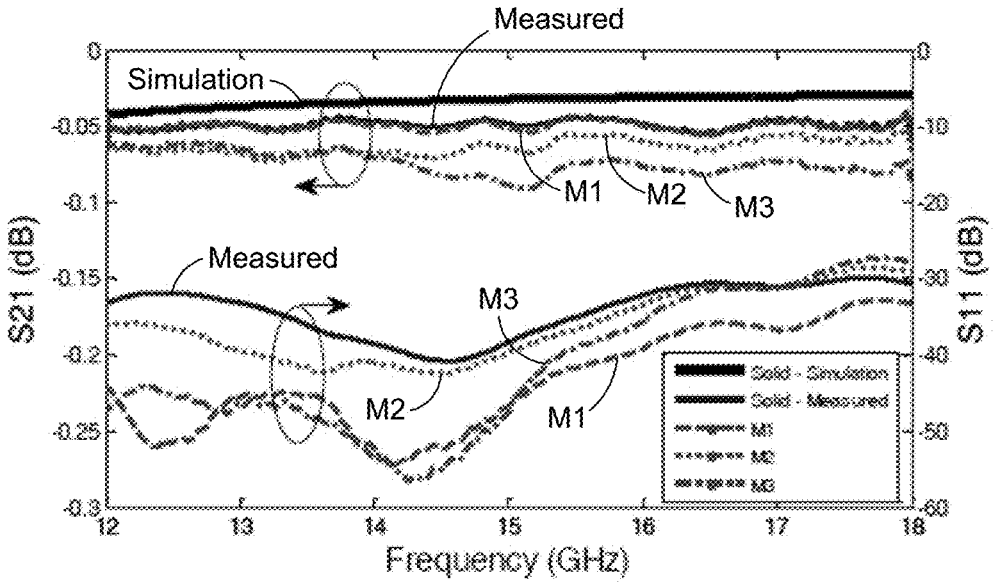
FIG. 7A is a graph of simulated and measured S-parameters of solid-walled and apertured waveguides and shows the transmission and reflection coefficients.
Figure 7B:
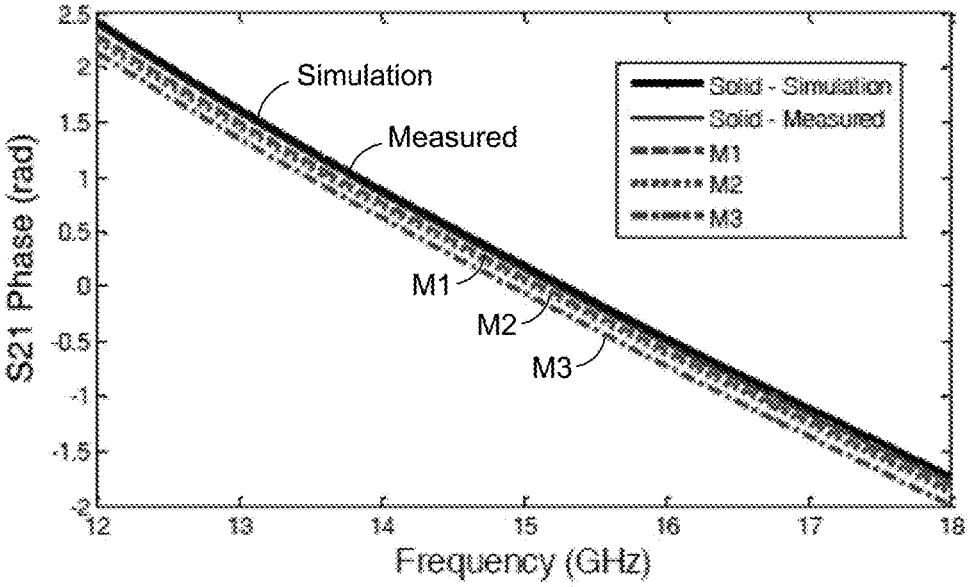
FIG. 7B is a graph of simulated and measured S-parameters of solid-walled and apertured waveguides and shows the phase of transmission coefficient.

The conductivity of the three-dimensional printed devices was measured using the Van der Pauw method. A value of 0.57 MS/m was obtained for the sintered stainless steel parts and a value of 3.73 MS/m was obtained for the Cu-infiltrated stainless steel. Also, the roughness of the printed copper+ stainless steel alloy was measured using a Dektak 150 surface profiler, obtaining a Ra value of 6.26 μm. Subsequently, the S-parameters of the printed waveguides were measured using a Keysight PNA N5227A calibrated with a Maury P7005E calibration kit. The responses are shown FIG. 7. The simulated $S_{11}$ of the solid-walled waveguide was approximately 70 dB across the band and is not included in FIG. 7A. The average attenuation constant over the frequency band (a) and the phase constant at 15 GHz (β) are summarized in Table I. For a reduction of 22% in density for waveguide M1, the loss only increased by 5%. In the case of waveguide M2, which was 39% lighter than the solid counterpart, the loss increased by 32%. These measurements suggest that the phase constant increases as the value of the dimension of the apertures ($m_a$) increases. To quantify the radiation properties of the meshed waveguide, the radiation losses of the three meshed designs (M1, M2, and M3) were simulated. The greatest radiation loss was observed for M3. This loss had a peak value of 0.009 dB/cm at 15 GHz.

Figure 8:
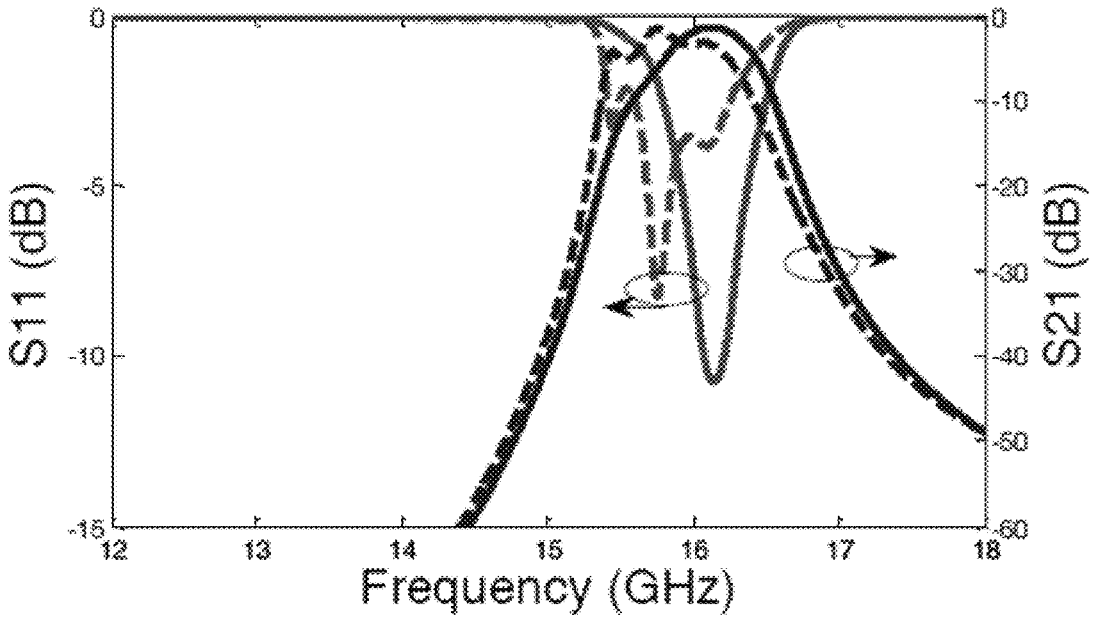
FIG. 8 is a graph that shows the measured response of fabricated waveguide filters.

For the manufactured filters, the measured responses are shown in FIG. 8 and the performance parameters summarized in Table II. The center frequency and bandwidth deviated from the design values mainly due to tolerances in the three-dimensional printing process that, in this case, was approximately 50 um. On the other hand, the center frequency of the meshed design shifted down by approximately 160 MHz due to the fact that the meshed walls increased the phase constant of the structure and therefore, lowered the resonance frequency of the cavities. Due to this shifting, both the return loss and the insertion loss were degraded because the coupling iris was designed for the ideal center frequency. In order to make a fair comparison, the maximum available gain of the filter was calculated and the resulting values were −0.981 dB for the solid-walled filter and −0.858 dB for the meshed filter. This means that the apertures of the mesh had little impact on the loss in the structure.

TABLE II

Filter Performance

| | Filter | $f_0$ (GHz) | 3 dB BW (GHz) | Min. IL (dB) | Max. RL (dB) |
|---|---|---|---|---|---|
| Simulated | Solid | 16.52 | 0.69 | 0.84 | 35 |
| | Meshed $m_a$ = 1.8 mm $m_b$ = 1 mm | 16.35 | 0.67 | 1.23 | 27 |
| Measured | Solid | 16.13 | 0.59 | 1.15 | 14.2 |
| | Meshed | 15.91 | 0.62 | 1.59 | 8.11 |

TABLE II-continued

| Filter Performance | | | | |
|---|---|---|---|---|
| Filter | $f_0$ (GHz) | 3 dB BW (GHz) | Min. IL (dB) | Max. RL (dB) |
| $m_a$ = 2.17 mm<br>$m_b$ = 0.63 mm<br>Density = 0.59 | | | | |

It is noted that, in some embodiments, electrodes can be inserted into the apertures of the waveguide for plating purposes. This enables one to plate complex structures that otherwise may not be possible to plate. In addition, it is noted that the apertures facilitate improved electroplating and/or electroless plating of interior regions of a non-metallic (e.g., polymer) waveguide. The apertures also enable uniform access of the plating solution (and plating current) to the interior channel of the waveguide. This is beneficial because, as is known in the art, it is often difficult to plate cavities.

The invention claimed is:

1. An apertured waveguide comprising:

four orthogonal walls that together provide the waveguide with a rectangular cross-section, each wall comprising a plurality of apertures; and an interior channel along which electromagnetic waves can propagate, the interior channel being defined at least in part by the four orthogonal walls.

2. The waveguide of claim 1, wherein the walls comprise a metal material.

3. The waveguide of claim 1, wherein the walls are solid metal walls.

4. The waveguide of claim 1, wherein each wall has a thickness of approximately 0.2 to 5 mm.

5. The waveguide of claim 1, wherein the apertures are arranged in parallel rows and parallel columns, each row and each column comprising a plurality of apertures.

6. The waveguide of claim 5, wherein the rows and columns are perpendicular to each other.

7. The waveguide of claim 1, wherein each aperture is rectangular in cross-section.

8. The waveguide of claim 1, wherein each aperture is square in cross-section.

9. The waveguide of claim 1, wherein each aperture has a cross-sectional dimension of approximately 0.1 to 20 mm.

10. The waveguide of claim 9, wherein each aperture is spaced from adjacent apertures by a distance of approximately 0.1 to 20 mm.

11. The waveguide of claim 1, wherein the interior channel is sized and configured to propagate microwaves along its length.

12. The waveguide of claim 1, wherein the interior channel has a width of approximately 7.1 to 165.1 mm and a height of approximately 3.6 to 82.5 mm.

13. The waveguide of claim 1, wherein the waveguide is dimensioned so as to be configured to operate as a cavity filter.

14. A method for propagating electromagnetic waves along a waveguide, the method comprising:

providing an apertured waveguide having a rectangular cross-section defined by four orthogonal walls, each wall including a plurality of apertures; and propagating the electromagnetic waves along an interior channel of the waveguide, the interior channel being defined at least in part by the walls.

15. The method of claim 14, wherein the waveguide walls are solid metal walls.

16. The method of claim 14, wherein the waveguide apertures are arranged in parallel rows and parallel columns of the waveguide wall, each row and each column comprising a plurality of apertures.

17. The method of claim 14, wherein each waveguide wall has a thickness of approximately 0.2 to 5 mm.

18. The method of claim 14, wherein each waveguide aperture has a cross-sectional dimension of approximately 0.1 to 20 mm.

19. The method of claim 18, wherein each waveguide aperture is spaced from adjacent waveguide apertures by a distance of approximately 0.1 to 20 mm.

20. An apertured waveguide comprising:

a single wall having a circular or elliptical cross-section, the single wall comprising a plurality of apertures; and an interior channel along which electromagnetic waves can propagate, the interior channel being defined by the single wall.

21. The waveguide of claim 20, wherein the single wall is a solid metal wall.

22. The waveguide of claim 20, wherein the single wall has a thickness of approximately 0.2 to 5 mm.

23. The waveguide of claim 20, wherein the waveguide apertures are arranged in parallel rows and parallel columns of the waveguide wall, each row and each column comprising a plurality of apertures.

24. The waveguide of claim 20, wherein each waveguide aperture has a cross-sectional dimension of approximately 0.1 to 20 mm and wherein each waveguide aperture is spaced from adjacent waveguide apertures by a distance of approximately 0.1 to 20 mm.

25. A method for propagating electromagnetic waves along a waveguide, the method comprising:

providing an apertured waveguide having a single wall having a circular or elliptical cross-section, the single wall comprising a plurality of apertures; and propagating the electromagnetic waves along an interior channel of the waveguide, the interior channel being defined at least in part by the walls.

26. The method of claim 25, wherein the waveguide walls are solid metal walls.

27. The method of claim 25, wherein the waveguide apertures are arranged in parallel rows and parallel columns of the waveguide wall, each row and each column comprising a plurality of apertures.

28. The method of claim 25, wherein the waveguide wall has a thickness of approximately 0.2 to 5 mm.

29. The method of claim 25, wherein each waveguide aperture has a cross-sectional dimension of approximately 0.1 to 20 mm.

30. The method of claim 29, wherein each waveguide aperture is spaced from adjacent waveguide apertures by a distance of approximately 0.1 to 20 mm.

* * * * *